US005845617A

United States Patent [19]

Sager

[11] Patent Number: 5,845,617

[45] Date of Patent: Dec. 8, 1998

[54] ROTARY GEAR PUMP WITH VANES

[75] Inventor: William F. Sager, Ormond Beach, Fla.

[73] Assignee: Sager Innovations Inc., Chicago, Ill.

[21] Appl. No.: 755,895

[22] Filed: Dec. 2, 1996

[51] Int. Cl.[6] ..... F02B 53/00; F04C 2/16

[52] U.S. Cl. ..... 123/238; 123/246; 418/201.1; 418/206.4

[58] Field of Search ..... 123/238, 246; 418/201.1, 206.1, 206.4

[56] References Cited

U.S. PATENT DOCUMENTS

| | | | |
|---|---|---|---|
| Re. 2,369 | 10/1866 | Roots . | |
| 892,295 | 6/1908 | Nutz . | |
| 1,135,648 | 4/1915 | Ahlm et al. | 418/201.1 |
| 1,155,335 | 10/1915 | Bricknell et al. | 123/246 |
| 1,344,331 | 6/1920 | Carrey | 123/238 |
| 1,459,552 | 6/1923 | Rathman . | |
| 1,656,538 | 1/1928 | Smith | 123/246 |
| 2,159,744 | 5/1939 | Maglott . | |
| 2,256,743 | 9/1941 | Kleckner . | |
| 2,481,527 | 9/1949 | Nilsson . | |
| 2,982,221 | 5/1961 | Whitfield . | |
| 3,164,099 | 1/1965 | Iyoi . | |
| 3,709,199 | 1/1973 | Molyneaux | 123/246 |
| 3,926,540 | 12/1975 | Grenier . | |
| 3,986,801 | 10/1976 | Garland . | |
| 4,548,562 | 10/1985 | Hughson . | |
| 5,108,275 | 4/1992 | Sager . | |

FOREIGN PATENT DOCUMENTS

| | | | |
|---|---|---|---|
| 3101600 | 8/1983 | Germany | 123/246 |
| 55-46077 | 3/1980 | Japan . | |
| 2-95789 | 4/1990 | Japan . | |

OTHER PUBLICATIONS

Article Design of Machine Elements, 5th Edition Spotts, M.F. (Prentice Hall, Englewood Cliffs, New Jersey) 1978, pp. 502–511.

*Primary Examiner*—Michael Koczo
*Attorney, Agent, or Firm*—Gerstman, Ellis & McMillin, Ltd.

[57] ABSTRACT

A rotary gear pump comprises a housing and at least a pair of rotatable, meshing gears positioned within the housing. The meshing gears define spaced teeth which extend helically in the general direction of the axis of each gear rotation. A flow inlet and flow outlet are provided, each positioned in the housing to permit flow of fluid substantially longitudinally of the rotation axes between the meshing gears as the gears rotate said teeth through a tooth-meshing area. At least one first vane covers the teeth of each gear at a rotational position upstream of the tooth-meshing area, to shield the covered teeth from an energy-consuming backflow of fluid from said tooth-meshing area as the gears rotate. Also, fixed-volume furnaces are used to receive and distribute compressed, burning gases from closing chambers formed between the teeth to opening chambers across the top dead center position.

19 Claims, 10 Drawing Sheets

ROTARY GEAR PUMP WITH VANES

BACKGROUND OF THE INVENTION

Rotary gear pumps having angled teeth are disclosed for example in Roots Reissue U.S. Pat. No. 2,369 and Garland U.S. Pat. No. 3,986,801, as well as Sager U.S. Pat. No. 5,108,275. Contrary to the more common gear pumps in which fluid is pumped between rotary gears in a direction transverse to the axis of rotation, the specific pumps of the class described in the above patents exhibits gears having teeth which are helically oriented, and in which the pumping action is in a helical path generally parallel to the direction of the gear axes. The helical gear teeth mesh with each other, creating chambers for pumping that transiently form and disappear, imparting motion to fluids which occupy the chambers in the direction longitudinal of the gear axes and in a spiral path around one of the gear rotation axis or the other.

Further details of this device are found in the above cited Sager patent, the disclosures of which are incorporated by reference herein.

While improvements to this type of rotary gear pump are described in the previously cited Sager patent, additional improvements may be provided to rotary gear pumps in accordance with this invention.

Typically, many of the rotary gear pumps of the type described are contemplated for use over a wide range of rotation rates. When employed for pumping liquids, especially in large volume and modest pressure (50–100 lbs. per square inch) the number of teeth may be small, (as low as 5), the diameter as large as the situation requires, and the rotation rate as low as required to prevent cavitation. When used to pump and compress gasses, especially under pressures as high as 100,000 psi, the number of teeth may be very large, as high as 2000 and the rotation rates as high as 50,000 rpm. One factor which relates to the ability of reaching compressions in the neighborhood of 1000 atmospheres or more by this invention is an effective means for dividing the compression process into thousands or millions of events per second. For example for a gear with 2000 teeth operating at 50,000 rpm would create 3,333,000 compressions per second and with a duration in as low as the nanosecond range, a feature which makes the device attractive for fast, high temperature reactions.

It is to be understood that in many applications the pump may be used in a reverse manner as a motor to generate torque. A particularly attractive use is as an internal combustion engine where the device acts first as a pump to compress the air-fuel mixture and then in the reverse fashion to act as a motor as the hot combustion products expand as rotation takes place. Internal combustion engines are intended to be included in the use of the term "pump" for the purposes of this description and the claims thereof.

DESCRIPTION OF THE INVENTION

An engine or other pump in accordance with this invention can be adapted to produce conditions suitable for approaching Carnot cycle efficiency, using a compression ratio which is increased by a factor of 10 or more over normal compression ratios for motors, while maintaining temperatures at a practical level.

Of particular promise is employment through a design presented here for a compression/ignition two cycle engine with, for example, 960 "cylinders" operating at a maximum speed on the order of 18,000 rpm, making possible 288,000 compressions per second. By this means the "chambers" which contain the high pressure can be made small enough to contain such high pressures with ease. Also, high compression ratios lead to high expansion ratios, which thereby lower the exhaust temperature, further increasing efficiency. Moreover, a cooling of the engine parts caused by the low exhaust temperature can reduce the need for additional cooling.

The rotary pump or engine of this invention also may be made of a size which is far less than for conventional spark ignition or spontaneous ignition engines of comparable horsepower. For example, a 250 horsepower engine operating at a fuel efficiency of 80% (close to Carnot efficiency) in accordance with this invention may be built with dimensions of 20 inches by 20 inches by five inches.

Furthermore, the construction of the engine of this invention may be very simple, having only four movable parts engaged in energy generation. Two kinds of toothed rotors are used among these four parts, one type being substantially a mirror image of the other. Additional moving parts may be used in the pumps to supply fuel and cooling water mixed into the fuel under very modest pressure. The system may be valveless.

The harmful emissions from a motor in accordance with this invention can be very low, particularly since the motor can be used with an oxygen providing agent such as water or alcohol mixed with the fuel. Also, the system may be far more silent than standard internal combustion engines because the exhaust issues in a stream of pulses at a frequency above the audible range at the slowest rotor speeds.

The water which is emitted may be condensed and recycled in a conventional manner, if desired, so that water does not have to be frequently added to a water tank carried by the vehicle for the engine. By the use of water (or alcohol) mixed with the gasoline, it becomes possible to operate the engine of this invention at temperatures which reduce or eliminate the need for an engine cooling system. Alternatively, a conventional engine cooling system may be provided, and the engine can burn pure gasoline without water or alcohol mixed in, provided the compression ratio is on the order of conventional, spontaneous-ignition internal combustion engines.

As another advantage of the invention, it would be desirable for the combustion of fuel from start to finish to take place at the "dead center" position of the structure that is analogous to the piston of the engine. To do this, some provision is required for starting and completing the combustion process, above and beyond the compression-expansion mechanism per se. A key to engine operation is to use a pump capable of reaching very high pressures, and also with the ability to discharge its contents almost completely at any desired compression ratio. The above is accomplished by this invention.

Furthermore, by this invention, heat loss and material leakage are minimized by (1) reduction in the cycle time of compression, ignition, and expansion; (2) by causing the major part of the combination of compression and expansion to occupy just a minute amount of an overall cycle of rotation of the rotors i.e., each compression/expansion chamber goes through its cycle in no more than about one percent of the cycle of a complete rotation of the rotors of this invention; and (3) by insuring that the process of each compression and expansion takes place in a region of minute volume and very low heat conductivity compared to the metal surfaces of conventional engines.

Furthermore, by this invention, no valves are required; no jet injection or spark timing measures are required, and the total number and variety of parts are drastically reduced.

As a further issue, as gases and other fluids moving at high velocity approach the teeth of the rapidly rotating gears, they can cause a reduction in the efficiency of the pump of this invention by the interaction of the gases against the rotating teeth of the respective gears. By this invention, undesirable interactions of flowing fluids against the gear teeth are reduced or eliminated, to provide a significant increase in the efficiency of the gear pump of this invention.

An important improvement in efficiency of compression also comes from the use of vane systems which allow chambers under vacuum or pressure below the designated final pressure to be filled to the desired pressure without loss of energy. This modification not only simplifies the operation of the engine but is also of use in any compression process where isothermal compression is desired.

It is a known fact that when an empty chamber is filled with a gas to any predetermined pressure the temperature at the close of the process undergoes little or no change. This is because as long as the confines of the chamber do not move, the gas can do no work, and if the walls do not conduct any heat the energy content of the gas is not changed. (First law of thermodynamics, change in energy equals heat in minus work out, and both of these quantities is zero.) On the other hand, if the walls of the chamber are moving, and the direction of the incoming air is in the direction of the moving wall, and its velocity is greater, then the change in momentum will provide a force due to momentum change which will drive the rotor forward and the temperature of the air will be lowered. At later stages, when the pressure has built up, the incoming gas will, through its momentum loss, act to compress the gas already present. The overall effect is to fill the chambers in a way to conserve energy. In the absence of the vanes for the pump in question, the chambers should typically remain sealed until the meshing process starts. At this moment gas would then enter the chamber in a direction opposed to the rotation. The vane system circumvents this difficulty by filling the chambers before the meshing process begins in a way which optimizes the direction of the air jets which fill the chamber, (tangential to the rotor motion). Also, by filling them gradually, energy consuming turbulence is minimized.

The novel configuration of the gear pump when employed to generate power takes advantage of the ability of the compression chambers formed between the rotor teeth, to expel their contents in an axial direction. At a position between the beginning of the meshing zone and the dead center plane the space between chamber walls becomes so small that the teeth begin to act as pistons as the chamber compresses, and the pressure soars abruptly to high values.

The chambers then preferably open to a fixed combustion chamber, adjusted so that the chamber begins to discharge when the pressure has reached the desired value. Because of the helical twist of the chambers, the chamber does not cross the dead center plane all at once, but rather this crossing moves from the outer end in an axial direction to the end of the gear closest to the rotor center. Because, at the point of crossing dead center the compression chamber is closed, this action sweeps the compression chamber and delivers its entire contents to the combustion chamber.

The combustion chamber which has been filled from chambers in an end gear segment in turn feeds the adjacent meshing zone forming chambers under expansion in the rotor segment which lies in the central region. The use of one gear segment to feed the expansion of another is done to cause the expansion chamber to fill from the very moment expansion begins. It is this feature which allows the operation of simulating complete combustion at the "dead center" position.

The central gear segments may share a (third) combustion chamber which accepts air-fuel and discharges its hot, high pressure products to the expansion side of the same gear segments. The fact that the expansion chamber is already open at the far end when it begins to open at the center is of no consequence since the expanding Chamber has already been brought up to full pressure by the contents of the end gear segment.

Because the expansion is not complete by the time a chamber reaches the end of the meshing zone, a vane system may be employed to relieve the excess pressure through jets typically directed toward the dead center plane so as to impart forward momentum to the rotor and conserve energy.

Also, a novel configuration of the gear pump is provided, permitting the reduction of motor parts, with each gear in the system meshing with at least two other gears.

Further in accordance with this invention, a method is provided for operating a compressing and expanding chamber-type engine, which comprises the following steps of operation. A fuel-air mixture is compressed in a series of variable volume chambers to a predetermined pressure by reducing the volumes of said chambers. Compressed air-fuel mixture from the chambers is diverted at the predetermined pressure to one or more substantially fixed-volume combustion chambers, where a substantial or complete portion of the combustion of the fuel-air mixture takes place. After at least substantial combustion of the fuel-air mixture, the high pressure, hot combustion products are passed from the fixed volume combustion chamber (or chambers) into a second series of variable volume chambers in a second zone, to drive expansion of the second variable volume chambers by the energy released from the combustion of the fuel-air mixture, to provide useful kinetic energy to drive the rotors and generate power. Then, the combustion products of the fuel-air mixture are expelled from the second variable volume chambers. This is typically accomplished by reducing the volume of the second variable volume chambers to essentially zero, while diverting their contents into an exhaust channel, typically at about atmospheric pressure.

Typically, it is preferred for combustion of the fuel mixture to be substantially completed in the fixed-volume combustion chamber, with the combustion contents of the chamber being then diverted to the second set of variable volume chambers. Typically, the first and second sets of variable volume chambers are defined by the chambers of meshing gears having helical teeth in accordance with the general teachings of U.S. Pat. No. 5,108,275.

The combustion chambers straddle the dead center plane and have an intake on the "upstream" side of the dead center plane (where the volume of the chambers is reduced to essentially zero, or at least a minimum volume) and an outlet on the "downstream" side of the dead center plane. The second chambers are formed on the downstream side of the dead center plane.

The term "upstream" refers to that direction which is against the rotation of meshing gears, while the term "downstream" refers to that direction which is in the direction of rotating gears. The dead center plane is a similar term to the "top dead center position" of the previously cited Sager patent, and is illustrated in the drawings and specification below.

It is also preferred for the fuel mixture to enter the fixed volume combustion chamber at a substantially supersonic velocity. This can be governed by the rotational velocity and the helical angle of the gear teeth used. While the velocity of the moving chambers defined between the meshing gear teeth may also be supersonic, the actual rotational velocity of the gears themselves and their teeth may be subsonic.

The rotary gear pump of this invention typically comprises a housing to hold at least a pair of, and preferably four, rotatable, meshing gears positioned within the housing, with the spaced teeth of the meshing gears extending helically in the general direction of the axis of each gear rotation at an angle to the axis of the gears of typically less than 15 degrees.

Typically one or more flow inlets and flow outlets are provided for the fluids passing through the gear pump of this invention, with each flow inlet and flow outlet being positioned in the housing to permit flow of fluid substantially longitudinally between the meshing gears, as the gears rotate their teeth through a tooth-meshing position with respect to another, meshing gear in the system.

Further in accordance with this invention, at least one first vane is provided to cover the teeth of each gear at a rotational position which is upstream of the tooth-meshing, dead center position, in a manner to shield the teeth which are covered by the first vane from an energy-consuming backflow of fluid from the tooth-meshing positions as the gears rotate. The cause of this back flow is that in the early stages of the meshing process, when the space connecting the forming chambers is too large to capture the air in individual chambers, pressure builds up during the chamber size reduction due to gear tooth meshing. The pressure continues to do so until the overall mass flow, even at its reduced velocity, equals that of the backflow. In the absence of vanes this pressure could cause the fluid to flow backwards into the space between the teeth and to impart a backward momentum to the rotor with a corresponding loss in energy. The vane system allows the chambers to be brought up to the steady state higher pressure in an energy conserving way.

Two methods of filling the chambers can be used, 1) fill the chambers as they form on passing through the dead center plane at the location where the exhaust is expelled from the chambers at the end of the expansion process or 2) allow the chambers to remain empty (in vacuum) until they approach the meshing zone where they are filled by means of a vane system. In option 2 a first vane covers the teeth to prevent backflow into the vacuum region. In addition a second vane system is required to increase the pressure to force the flow into the meshing zone. Option 2 has the advantage that much of the casing which envelops the engine is under vacuum so that any outside leakage is into rather than out of the engine itself. This feature completely eliminates the blow-by problem responsible for much of the environmental air pollution. Every bit of the outflow is in the exhaust stream.

The remaining vanes in each system cause the air to enter gradually through jets which direct the flow in a direction generally tangential to the gear circumference and in the direction of the tooth motion.

By this invention, one, and preferably several, spaced first vanes are positioned to protect advancing gear teeth from the fluid which is being driven against the direction of gear rotation. That fluid then dissipates its velocity against a stationary wall, the housing, or another wall as desired, and then comes back around or between the vanes to flow into the spaces between the teeth of the rotationally advancing gears.

By this means, a significant improvement in efficiency of the pump of this invention can be achieved, especially at rotational velocities which give tip speeds approaching sonic velocity.

In the part of the gears which is rotationally downstream from the dead center tooth meshing position, highly pressurized fluid, typically from a fixed volume combustion chamber, expands by a reverse of the compression process. Since compression is driven by torque given to the rotor, the expansion causes the torque to be given back to the rotor, with interest. In the combustion chamber there is a very large increase in volume due to the temperature rise (at constant high pressure) and also due to the vaporization of the preferred large water content of the charge. These factors cause the torque received by the rotor to greatly exceed that which it donates for compression, and the net result is efficient power production. Because the central expansion chambers only handle the expansion in the meshing zone for all of the rotor and because the expansion ratio, although large, is limited, the pressure at the end of the meshing zone expansion is not completely reduced to atmospheric.

Here also an efficiency can be created by one, and preferably a plurality of, spaced, second vanes which cover the teeth of the gears at a rotational position downstream of the dead center tooth meshing position, to direct depressurizing, expanding fluid from between the gear teeth into a flow direction which is substantially opposite to the direction of gear rotation. The effect of this is similar to the action of a jet engine, in which the pressurized fluid depressurizes primarily in the direction opposite to rotation of the gears, thus imparting an equal and opposite push to the rotating gears.

A first vane system over the central expansion chambers is preferably provided with a port extending to a similarly constructed vane system over empty end expansion chambers so that these chambers are pressurized in an energy efficient way. Both end and central expansion chambers then deliver their contents into a second set of vanes to complete the expansion to atmospheric pressure. The second set of vanes preferably empties into the region enclosed by four interconnecting rotors, which provide confinement for the exhaust except at the ends, where a partition at the rotor ends provides confinement and the exit port for the exhaust. Thus, by this invention, the vanes provided herein result in a significant improvement in efficiency of operation, particularly in energetic terms.

From there, the depressurized fluid passes through the exhaust port or ports out of the pump system.

Preferably, as above, the pump of this invention comprises at least four rotatable, meshing rotor gears which are positioned in interconnecting array, in which each gear meshes with at least two other gears. By this, multiple meshing teeth pumping sites can be provided to the system, and other advantages can be achieved.

It also is preferred for a pair of the spaced first vanes respectively covering teeth of different gears to be connected to each other by a continuous wall to facilitate pressurization of fluid for pumping adjacent the first vanes and to maintain an outer vacuum. By this, an inner chamber can be provided without the use of the housing, in which fluid for pumping is pressurized by the continuing backflow of fluid as it spills and flows retrograde out of the shrinking spaces between the gear teeth on the compression side.

Thus, by this invention, the vanes provided herein result in a significant improvement in the efficiency of operation, particularly in energetic terms.

It is also desirable for the second vane system to accompany the first vane system on each side of the top dead center position as described above. The second vane system on the upstream side is provided to increase the pressure within the volumes between meshing teeth to match the pressure of the air or air-fuel mixture at the entrance to the meshing zone. At the following ends of the vane systems is a part which covers the volumes between adjacent teeth so as to prevent passage of air into or out of those volumes. Each vane system has barriers at each end of the volume between teeth to prevent passage of air either into or out of the ends of that volume.

Preferably, the geared shafts of this invention define a pair of end segments and a pair of central segments, each having helical teeth. Each end segment is separated from its central segment by a circumferential groove. The central segments also define a third circumferential groove between them.

The above described vane system may be provided for each of the central segments described above to deliver combustion products from the chambers between the gear teeth to an exhaust collection region to impart a velocity to the combustion products in a direction which is approximately opposite to the direction of tooth motion, thereby imparting a forward momentum to the teeth through reaction to the backward momentum of the exhaust, as previously described. The second vane system accepts combustion products from the above described first vane system. These combustion products fill the volume between the teeth, which are expanding, having been newly formed through rotation beyond the top dead center position.

Constant volume combustion chambers or furnaces may reside in circumferential grooves of the rotors. At least some of the combustion chambers preferably carry an adjustable area entry port and an adjustable area exit port, each of which comprises a laterally sliding partition which slides transversely to the axis of the rotors. Thus, by proper adjustment of the partition, the rotational position at which respective first and second chambers on different sides of the top dead center plane communicate with the combustion chamber may be selectively adjusted, so that each first chamber cannot discharge its contents into the combustion chamber until a predetermined position and corresponding compression ratio is achieved. Similarly, the opening second chambers cannot communicate with the combustion chamber until they have reached a predetermined size, since prior to that they are blocked from communication with the combustion chamber by the sliding partition. These sliding portions are called "throttles" below.

Each of the helical gears preferably also define cylindrical end sections which are free of teeth and which touch each other in rotational relationship. These cylindrical sections thus may be used to precisely space the interengaging teeth of the shaft, which teeth are positioned on the shaft between the cylindrical segments.

Preferably, the rotating helical gears as described above are operated in the compression and pumping of a gas in which the gas is pumped axially between the gears, as before, from one end of the gears to the other (or to a central portion as specifically shown) and compressed in so doing.

One may pass at least some of the compressed gas from the other gear end or ends to a heat exchanger for cooling the compressed gas. At least some of the compressed gas is then conveyed to the inlet end of the gears to mix with inlet gas to increase the volume of gas flow through the meshing gears and to reduce the temperature of operation, particularly in the situation where combustion of the inlet gas is taking place during the process prior to entering the meshing gears. Furthermore, one may optionally include the step of delivering some of the compressed gas to a use or storage zone. Also, if desired, the inlet gas may be precooled and precompressed prior to delivery to the one end. Advantage is achieved when this process is used in conjunction with the vanes previously described. Efficiencies of operation are achieved, providing a pump (including motors) which may approach isothermal operation; i.e. motors and other pumps may run at surprisingly low temperatures while delivering high power and high efficiency with high compression, with the result that problems of lubrication are greatly simplified.

The vane system described above, especially when the flow through the vanes is high volume and high pressure, as can be accomplished by the recirculation and cooling of hot, pressurized gas which is passed through the pump, provides significant efficiency and conversation of energy as the high pressure gas passes through the vanes to add its momentum to the rotor, as previously described. The cooled, compressed gas increases the mass of material needed to reach a given compression ratio in the pumping. Thus high compression ratios, resulting in efficient operation, can be achieved with less temperature increase per unit of mass flow in the device, whether operating as a motor or as a pump for gas or other fluid.

In the prior art, multiple stage compressions employing separate pumps for each stage and with intervening cooling are used to address this problem with large pumps. Such is expensive, wasteful of space, and far from complete unless a great many stages are used. By this invention, the pump compresses the incoming gas (gasoline and air, optionally with water added for example) with cooled, recycled, pumped gas, which performs the function of the piston in a conventional piston pump of a compressor. This gas "piston", in contrast to an ordinary piston, mixes with the incoming gas, and in this way delivers the cooling acquired in the heat exchanger before the compressed gas leaves the pump. Because the recycling part of the pumping action is essentially a constant volume procedure, it neither absorbs nor delivers work, and thus does not reduce efficiency for that reason. The only net change is compression of the incoming gas and delivery of the compressed, pumped product to the user (or as exhaust in an engine) and heat to the heat exchanger. In the event that the pump device or this invention is an air compressor, some of the compressed air will be delivered to the user, and some will be recycled back to the pump.

Thus, energy advantages and increased efficiency are achieved with the above pump.

An additional feature is associated with applications of the above invention where the pump is used as a prime mover in the energy recovery stage of supercharged engines. Here the vane array used in the pumping process can efficiently recover energy of gas expansion.

As well as being used as a motor, the pump of this invention may be used as pumps for air conditioners such as heat pumps, dehumidifiers, air compressors, liquid air production machines, vacuum cleaners, low and high vacuum pumps (the high vacuum pump may operate without pump oil by this invention).

For ripple free flow in accordance with this invention, it is preferred for the gear teeth to have a total angle of wrap as described in the cited U.S. Pat. No. 5,108,275 of essentially three hundred and sixty divided by twice the number of teeth on the gear, in degrees, multiplied by an integer, for example 1, 2, or 3.

DESCRIPTION OF SPECIFIC EMBODIMENTS

Figure 1:
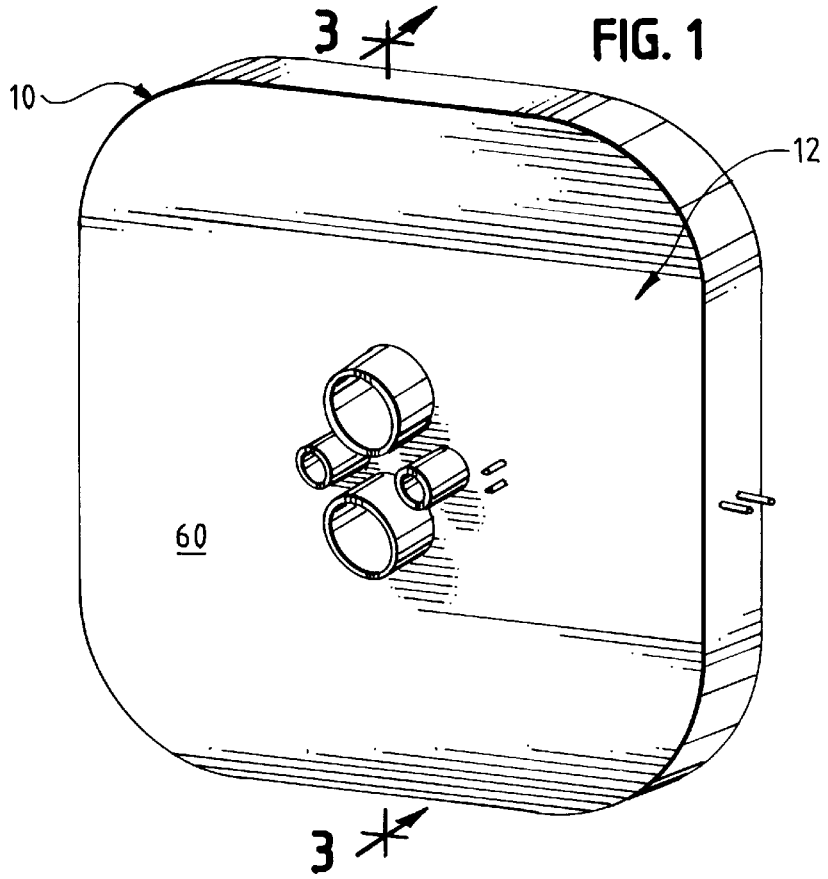
FIG. 1 is a perspective view of one side of the engine of this invention.
Figure 2:
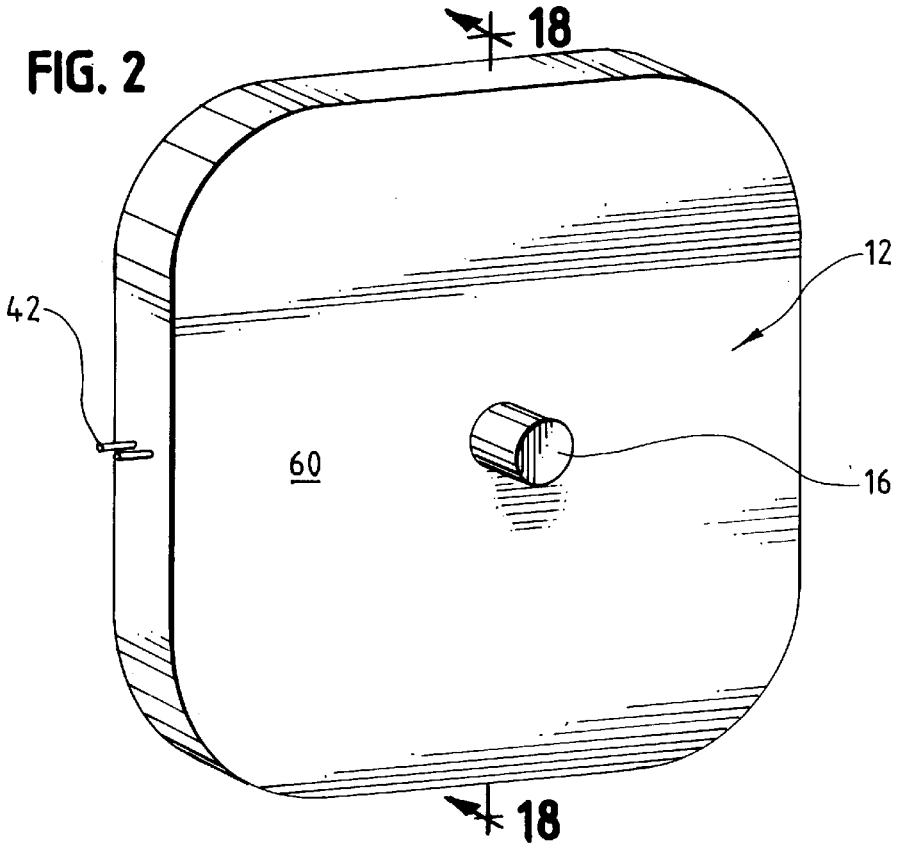
FIG. 2 is a perspective view of the other side of this invention.
Figure 9:
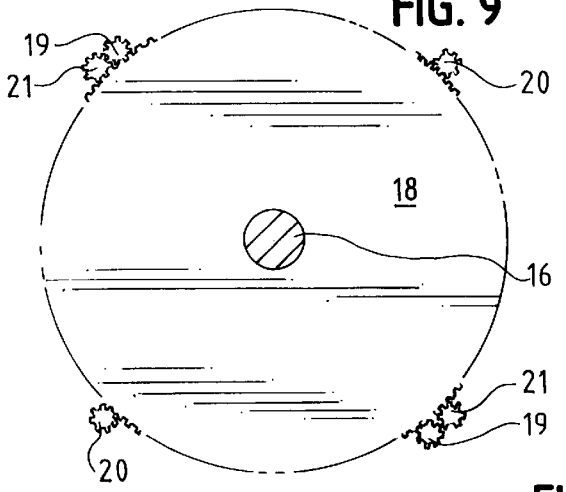
FIG. 9 is an elevational view, with parts removed, of the mounting for the drive shaft carried in said motor and the gearing system for the toothed rotors.
Figure 9A:
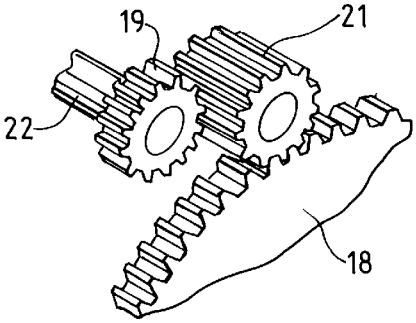
Figure 10:
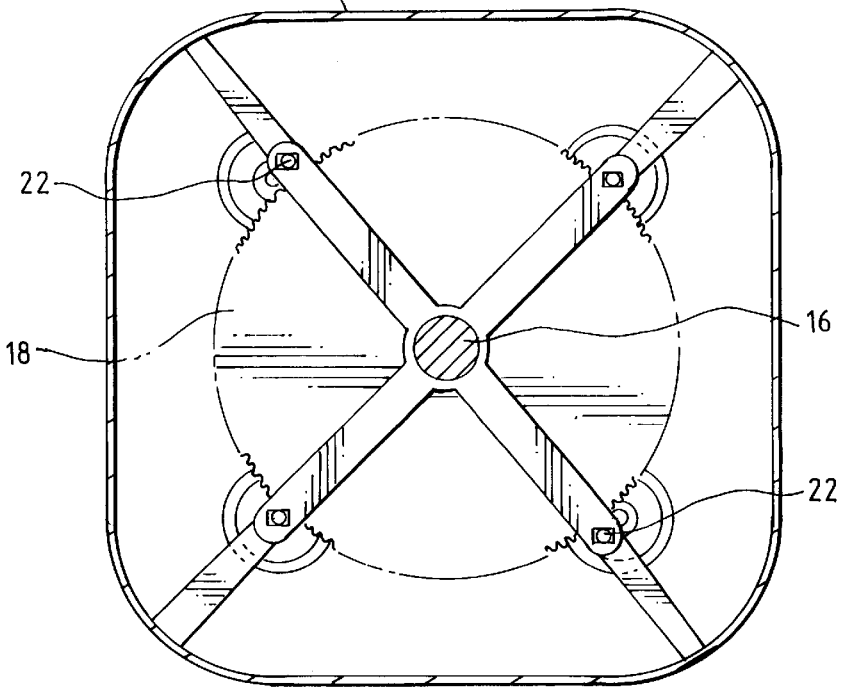
FIG. 10 is a front elevational view of the rotor drive mechanism.

Referring to the drawings, FIGS. 1 and 2 show an internal combustion engine 10 utilizing the pumping principles of this invention. Engine 10 comprises a housing 12 having a drive shaft 16 (FIG. 2) projecting outwardly. Drive shaft 16 communicates with a central drive gear 18 (FIG. 9) within housing 12. Gear 18 communicates with four driving gears 20, 21 which are in meshing relation with drive gear 18.

Figure 3:
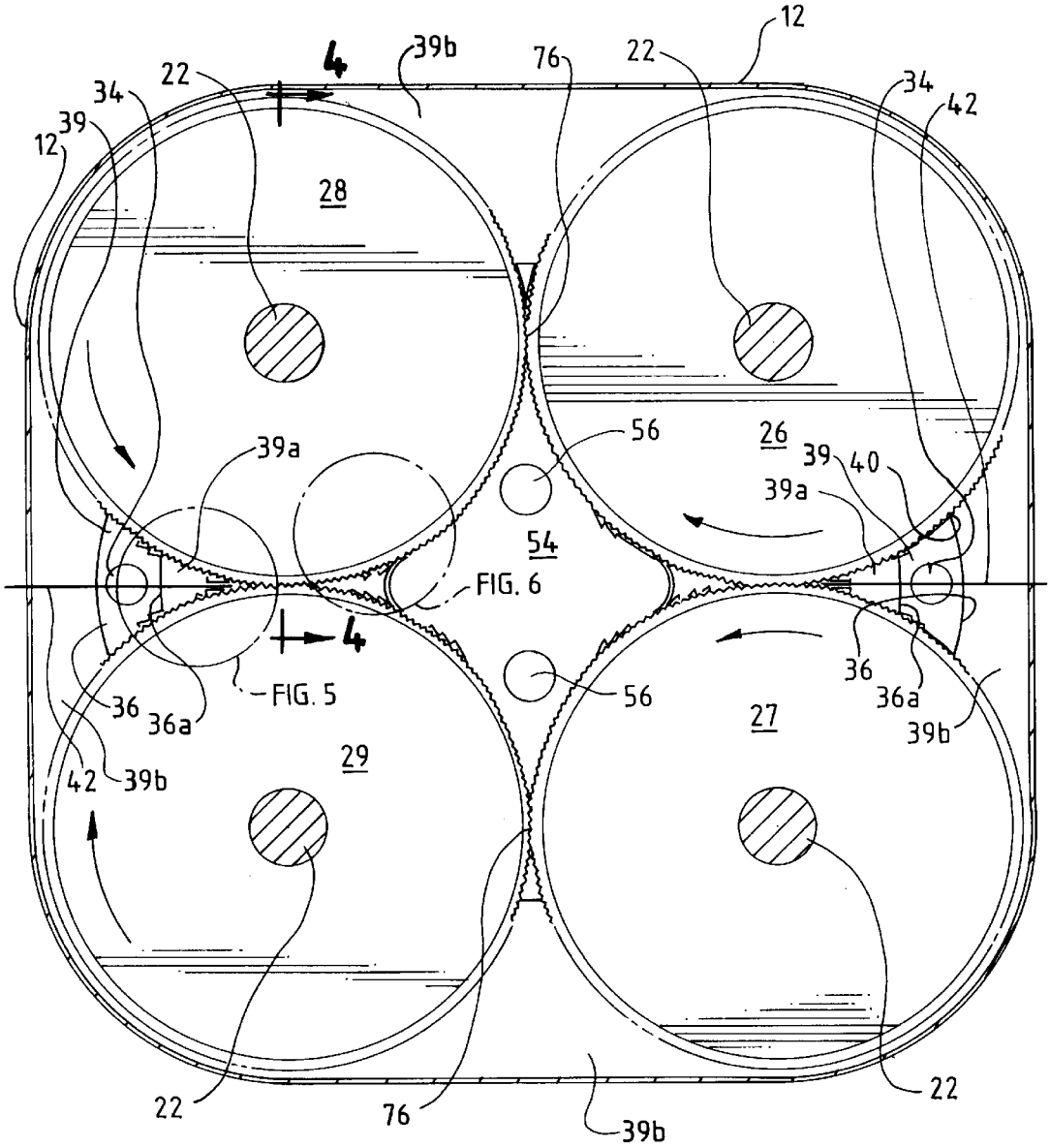
FIG. 3 is a transverse sectional view of the engine of FIGS. 1 and 2, taken along line 3—3 of FIG. 4.

Drive gears 20, 21 each connect to an axle 22 (FIG. 3), drive gears 21 each connecting to an axle 22 via reversing gears 19. Each axle 22 is centrally and respectively connected to a circular rotor gear 26, 27, 28, 29, which are shown in FIG. 3. The respective rotor gears are rotationally interconnected with each other in square array by the respective engagement of four rows of gear teeth 30, 31, 32, 33 (FIG. 4), separated by outer annular grooves 35 and inner annular groove 37.

It can also be seen that the respective gear teeth 30–33 are slightly angled from the usual gear tooth position of perpendicular to the major faces of the gear. The respective gear teeth 30–33 mesh with the corresponding gear teeth 30*a*–33*a* of the adjacent rotors to provide the gear pumping relationship which is more fully disclosed in Sager U.S. Pat. No. 5,108,275, the disclosures of which are incorporated herein by reference. Basically, the meshing teeth of the respective rotor gears 26–29 cause a pumping action to take place in a direction generally parallel to the axis of rotation of the rotating gears. Each of said rings of gears 30–33 may carry preferably about 150 to 400 teeth. For example, 200 teeth. The preferred total "angle of wrap" of each of these teeth (as defined in the previously cited U.S. Pat. No. 5,108,275) may be in a preferred range as defined therein.

Different rotor gears 26–29 may be of different diameters, and may have different numbers of teeth (of identical shape and of circular cross-section at outer ends). This facilitates even wear distribution.

Figure 3A:
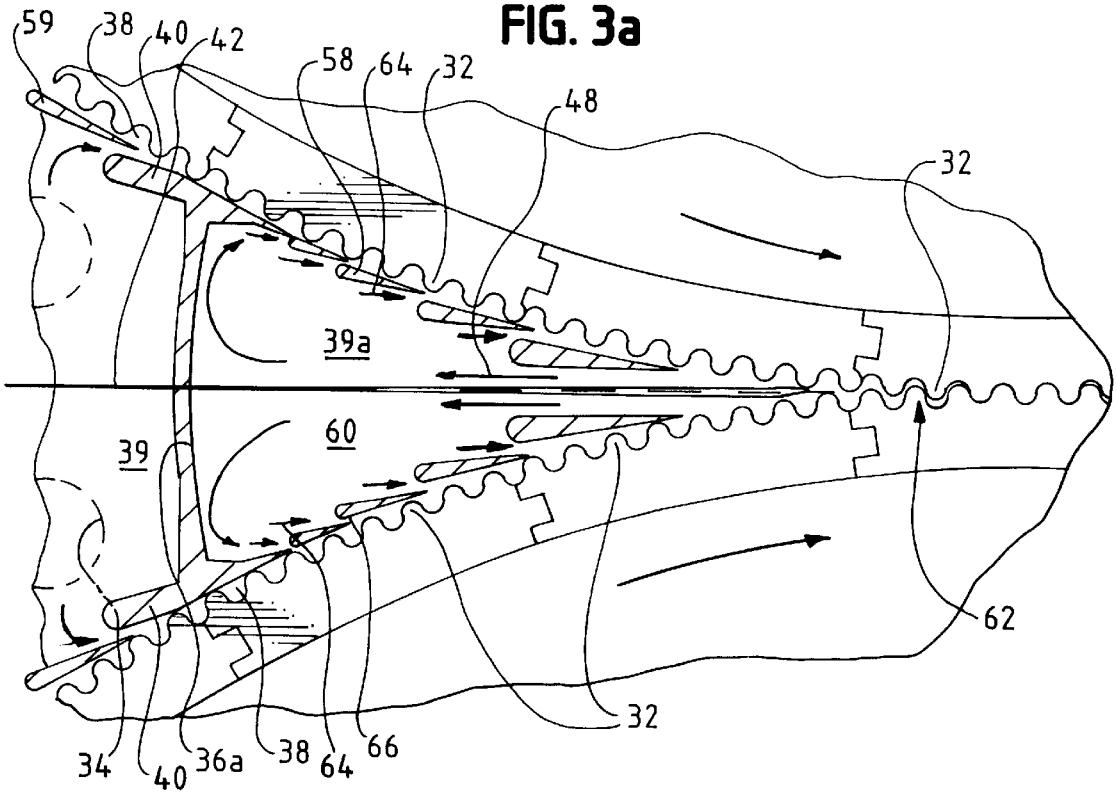
FIG. 3*a* is a fragmentary, enlarged, transverse sectional view of a inner portion of the compression vane system as shown in FIG. 3.

Referring to FIGS. 3 and 3*a*, air enters the motor system at two opposed inlet ports 34 near an end of the rotors 26–29. The air is impelled by the respective rotational directions of the rotors, as shown by the arrows, to flow about the peripheries of rotor gears 26–29 between the respective gear teeth of the rotor gears.

A continuous wall or partition 36 is provided at positions which are rotationally "upstream" of the meshing areas between gears 26 and 27, and 28 and 29, to provide an isolated chamber 39 to which access of air is provided primarily by the air in spaces 38 between the gear teeth 32 (FIG. 3*a*), which may hereafter represent any of teeth 30–33. Outer partition 36 defines an outer chamber 39 into which inlet port 34 communicates, while permitting outermost chamber 39*b* to be a substantial vacuum, since air is being constantly carried from that area by the spaces between the respective gear teeth. Evacuated section 39*b* extends about the peripheries of the rotors 26–29 to a respective upper and lower section as well.

An inner partition 36*a* is also provided to define an inner chamber 39*a* which, during operation, is at a higher pressure than the pressure in chamber 39. As shown particularly in FIGS. 3*a* and 3*c*, the ends 40 of partitions 36, 36*a* lie over spaces 38 at certain points of rotation to provide a partial seal. Air is conveyed to the spaces between the rotating teeth of gears 26–29 from chambers 39, 39*a* in a continuous flow through vanes 58, 59. Chamber 39*a* receives backflowing air 48 from between the closing teeth.

A fuel inlet line 42 extends through housing wall 12, walls 36 and 36*a*, and chamber 39 to the rotational position of the respective gears where the gear teeth 32 begin to mesh. As the gear teeth mesh, discrete chambers 44 are defined (FIG. 6), with a steady reduction of chamber volume taking place as the rotation proceeds. Note the difference in FIG. 6 between chambers 44 and 46. The chambers migrate axially along the gears on rotation, as well as in decreasing in volume, until they reach the minimum or zero volume dead center rotational position DCP. This volume reduction compresses the fuel-air mixture which is in the chambers 44, 46, and forces it to move axially along the gears.

As stated, an initial effect of the decline in volume of the respective chambers 44,46 is a backflow of air and the fuel carried with it into chamber 39, as indicated by arrow 48 in FIG. 3*a*. At high rotation rates for the rotor gears, this backflow can be substantial, with the result that the backflowing vapor could impinge against the advancing forward surfaces of the respective gear teeth 32 (but for the vanes) which would consume energy and result in an operating inefficiency.

Figure 5:
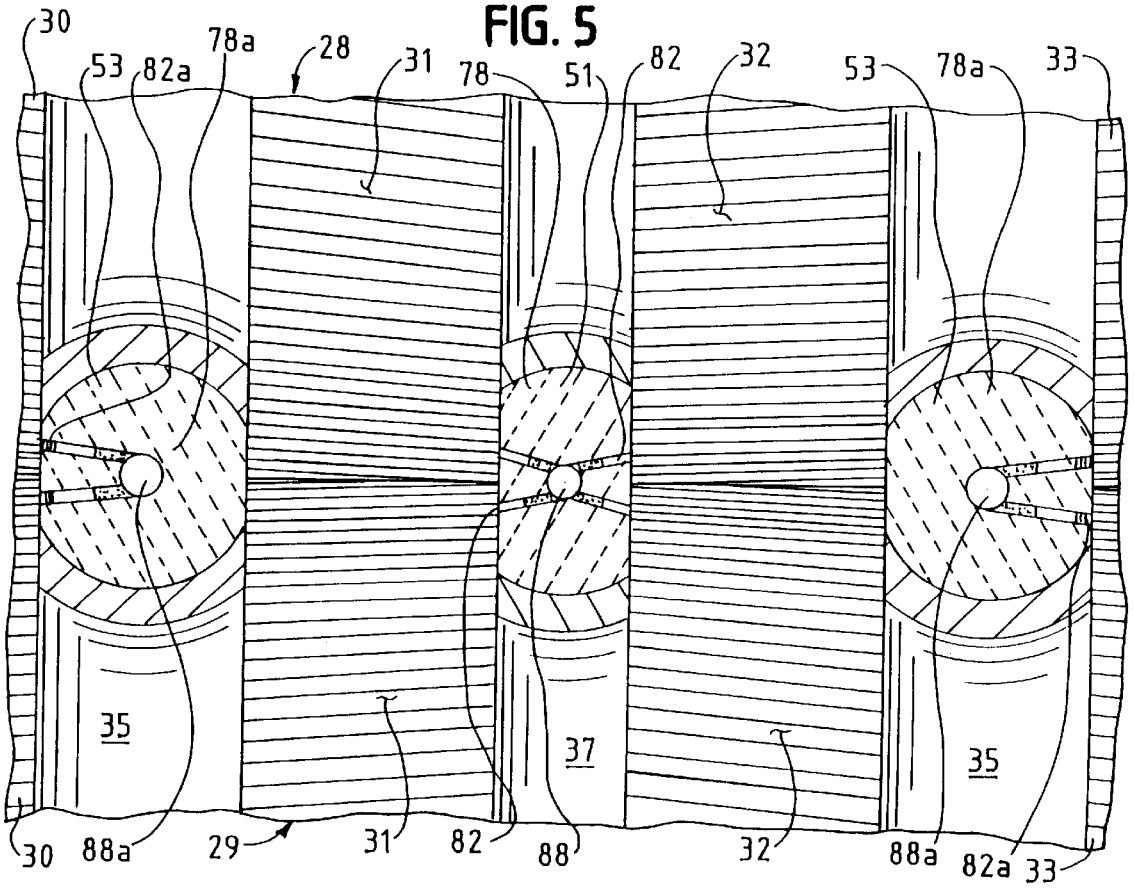
FIG. 5 is a highly magnified view of a portion of FIG. 4.

Eventually, at about the stage of chamber 44 between the meshing gear teeth, the so-called "third stage compression" as described in the previous patent, takes place so that sealed chambers are formed, with the result that substantial, sealed compression takes place as the volume of chamber 44 is reduced to the volume of chamber 46 and more so, going toward the zero or minimum volume point near the dead center plane DCP between the two gears. At about this point, typically by dieseling action from the high compression involved, the fuel-air mixture ignites in each chamber simultaneously. It is transferred by pressure to thick-walled ceramic mixing chambers or furnaces 51, 53 (FIGS. 5, 7, and 8). The ceramic has low heat conductivity to reduce engine part heating.

The fuel inlet 42, typically with admixed water, feeds the chambers from the chamber end nearest the combustion chamber or furnace and under circumstances which prevent the fuel from traveling away to any extent from its point of entry into the compression chambers 44, 46. Compression to high pressure takes place so abruptly that there is little or no ignition, and the temperature is preferably moderated by the presence of the water or alcohol. Once discharge into the combustion chambers 51, 53 occurs, the fuel rich component ignites, typically followed by an intense blast of high pressure air. Because the chambers 51, 53 are extremely hot and the conditions for spontaneous ignition are met by a wide margin, the slowest process is mixing of the fuel and air. The path through the chamber assures almost instantaneous mixing. There are multiple points of entry 82, 82*a*, one above the other (FIG. 7*c*) through which alternate strong pulses attend the entry into a channel 88, 88*a*. Violent turbulence is assured, and the high temperature of the chamber and its contents assure ignition. At any given time the combustion chamber contains the charges from many individual expansible rotor chambers so that there is opportunity for thorough mixing and combustion.

At the downstream furnace ends (FIGS. 7*a* and 7*d*) the process of travel is through horizontal channels 88, 88*a* to the outlet 96, 96*a*, optionally with a control partition 104. All these pulses and changes in direction of flow, coupled with the turbulence associated with fast flow through a channel, and the accumulation of many charges simultaneously during the combustion process, permits far more complete combustion than is possible with the conventional spontaneous ignition engine.

In the conventional engine the fuel is introduced at very high pressure through very fine jets directly into the compression part of the cycle. The fuel must evaporate, mix, ignite, and burn in the short time during which the piston is close to the dead center position. Much of the pollution problem is associated with these difficult combustion conditions. The water or alcohol mixed with the fuel can moderate the temperature for at such high compression ratios, ratios essential for low exhaust temperature and high efficiency, to avoid temperatures that rise to the point where nitrogen oxides are produced and at which the metal parts would fail.

Then, each gear chamber 52 (FIG. 6), as it forms on the rotationally downstream side of the rotating gears 26–29, receives ultrahigh-pressure burned or burning fuel from furnaces 51, 53, creating an expansive force. This expansive force is converted into rotational energy as the respective "downstream" chambers 52 expand, providing the driving torque to shafts 22, 23 and thus drive shaft 16.

Then, as the chambers 52 open to lose their "third stage" compression seal. The exhaust gas is released through vanes 68 (FIG. 3B) into central space 54, from where it eventually flows out of the engine through exhaust outlets 56, as discussed later.

It can be seen that in the engine disclosed (FIG. 3), four interengaging, toothed rotor gears are provided in a square, interconnected relation. Other arrangements of the rotor gears may be provided as well. For example, six rotor gears may be placed in a hexagonal array with interengaging rotation, or the like. Typically, any even number of rotor gears of preferably at least four may be placed in any loop configuration.

Figure 4:
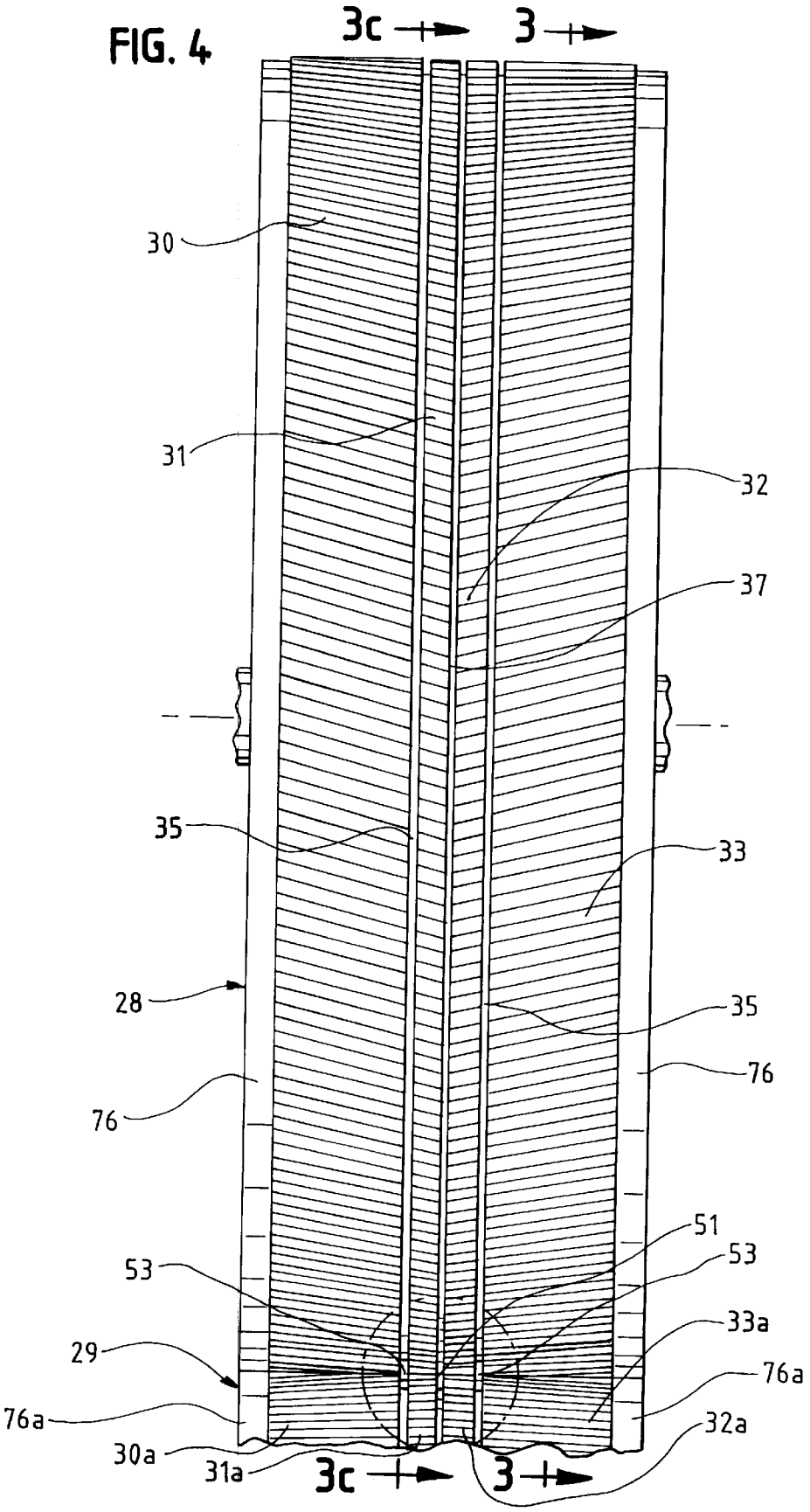
FIG. 4 is a partial, longitudinal sectional view of a portion of the motor taken along line 4—4 of FIG. 3.

FIGS. 4 and 5 provide additional details of the functioning of the pump or motor of this invention.

FIG. 4 shows one of the toothed rotors 28 and a fragment of the mating tooth rotor 29. Each rotor has respective gear tooth sections 30, 31, 32 and 33 engaging the corresponding gear tooth sections 30*a*, 31*a*, 32*a* and 33*a* of the other rotor. Each of the gear tooth sections of the rotor is separated from other sections by outer annular channels 35 and inner annular channel 37. Tiny, outer furnaces 53 and inner furnace 51 are respectively carried in channels 35, 33.

One main purpose of the furnaces is to permit the transfer of fluid in the chambers formed by the gear teeth across the dead center plane, where the volume of the chambers between the gear teeth are typically reduced to zero. Furnaces 51, 53 (FIG. 4*a*) communicate with the diminishing volume chambers 46 (FIG. 6) at a desired compression level to permit shunting of the contents of the chamber through the furnaces, across the dead center plane DCP, and back into the newly formed, expanding chambers 52 formed by the continuation of the rotating gear teeth.

In the case of an engine, a great amount of fuel compression may take place in the shrinking chambers 44, 46. Compressed, burning fuel (by diesel action) is passed into the furnaces, which are very small, and typically made of a ceramic material. Then, the ultra-high pressure, ultra hot combustion product is passed from the furnaces into the newly formed chambers 52 as they are opening, downstream from the DCP. The ultra high pressure of the combustion product forces the chambers to expand, imparting a rotational torque to the rotating gears, which corresponds to the power stroke of a conventional engine. This power stroke continues in each chamber until shortly after the time that the seal of each individual chamber is broken, thus causing the pressure to drop.

Roller disks 76, 76*a* abut each other to precisely space the respective rotor gears 26–29, thus avoiding tooth wear.

Figure 4A:
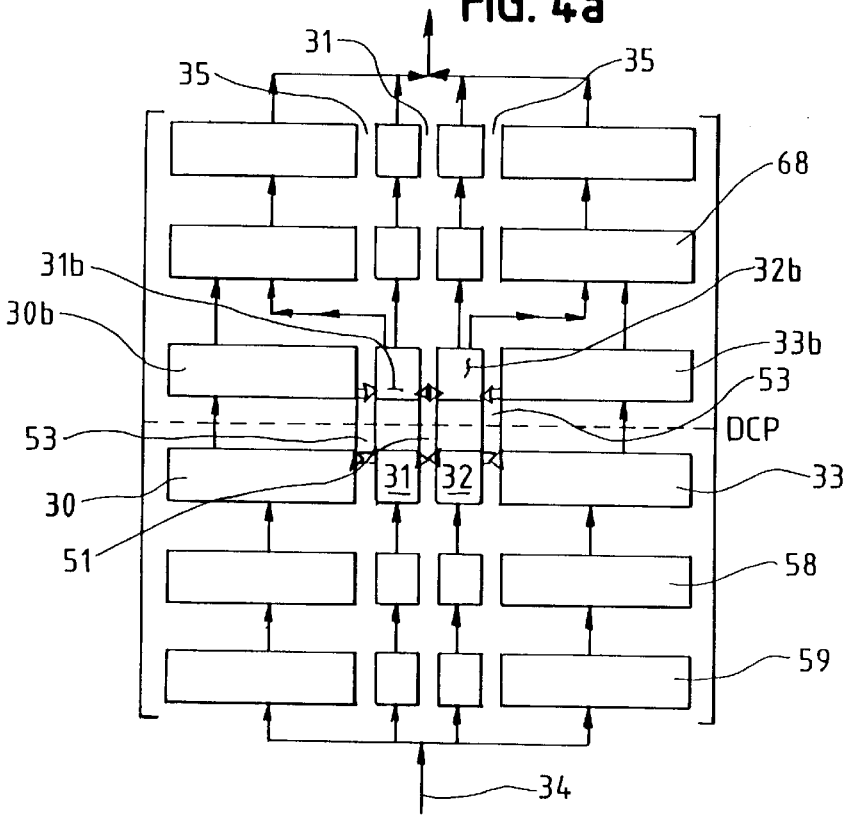
FIG. 4*a* is a schematic view of a single engaging roller from the dead center plane and from the area of roller engagement with another roller,taken 90° to FIG. 4 and showing in a schematic manner the functional regions and flows of the system.

Referring particularly to FIG. 4*a*, a view of one rotor 28 is shown from the dead center plane (DCP) at the junction with the other rotor 29 which it engages. Air 34 comes to spaces between the teeth from both ends of the rotor, to bathe a complete side portion thereof, passing through outer vanes 59 and inner vanes 58 (FIG. 3*a*). Fuel line 42 comes in a direction perpendicular to the plane of the drawing, being applied to gear teeth 32 at a point spaced from but fairly near the DCP as shown for example in FIG. 3. The initial compression and formation of the compressing chambers 38, 44 takes place between gear teeth. As rotation takes place, the chambers 38, 44, and 46 (FIG. 6) reduce in volume, receive fuel, and compress to a minimum, predetermined compression ratio. At that point, the contents of each diminishing volume chambers from gear sections 30, 33 are respectively expelled into inlets 82*a* of outer furnaces 53 from the respective tooth section ends. Furnaces 53 are respectively positioned in one of the annular grooves 35. Combustion takes place here, initiated through dieseling action, causing an extremely high increase in temperature and pressure.

Each of furnaces 53 has an outlet leading to expansion sections 31*b*, 32*b* (FIG. 4*a*) of the rotor, which can be seen to be on the other side of the dead center plane, DCP. Thus, the ultra hot plasma coming from each respective furnace 53 drives expanding chambers newly formed by the gears in sections 31*b*, 32*b* to power the motor, just as an expanding cylinder powers a conventional motor.

Figure 6:
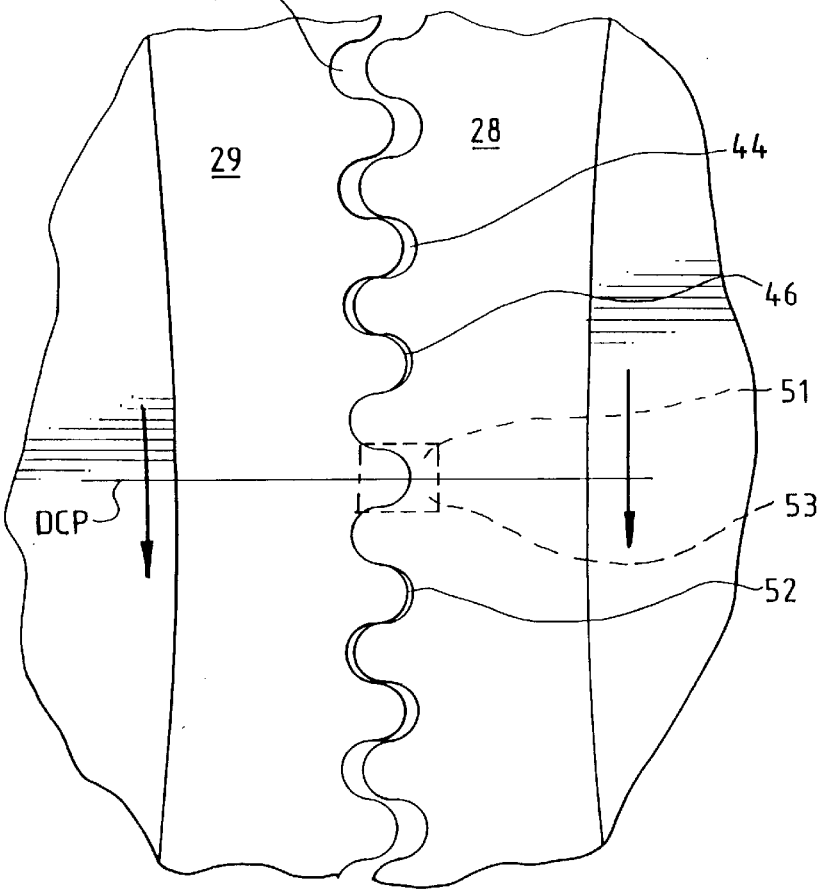
FIG. 6 is a highly magnified, fragmentary, transverse section showing the engaging teeth of two of the gear teeth rollers of the motor, with the dead center plane being shown.

Also, the spaces between the gear teeth of sections 31, 32 pick up air and fuel from fuel inlet lines 42 and participate in a similar compressive process. As chambers 38, 44 are formed between these meshing gear teeth, and as they compress in their rotation toward the dead center plane DCP, their contents are deposited from both sides into the inlets 82 of inner furnace 51, which also extends across the dead center plane. The volumes of the respective chambers are reduced to zero at the dead center plane, and then begin to open again, forming new chambers 52 (FIG. 6). The ultra hot, ultra high pressure plasma in furnace 51 is then passed through outlets 96 into these expanding chambers, providing additional ultra high pressure plasma or fluid to the expanding chambers in rotor sections 31*b* and 32*b*, providing further power through an expansive force that increases chamber volume, and thus imposes a torque on the rotors 28, 29.

Rotor sections 30*b*, 33*b* define chambers that expand, but in this embodiment do not receive much burning fuel, so little motive power is provided from those sections. The expanding chambers in sections 30*b*, 33*b* will pick up exhaust gasses through transverse channel 111 in the groove seals 112 that are found only in each of grooves 35, 37 (FIG. 3*c*).

Figure 3B:
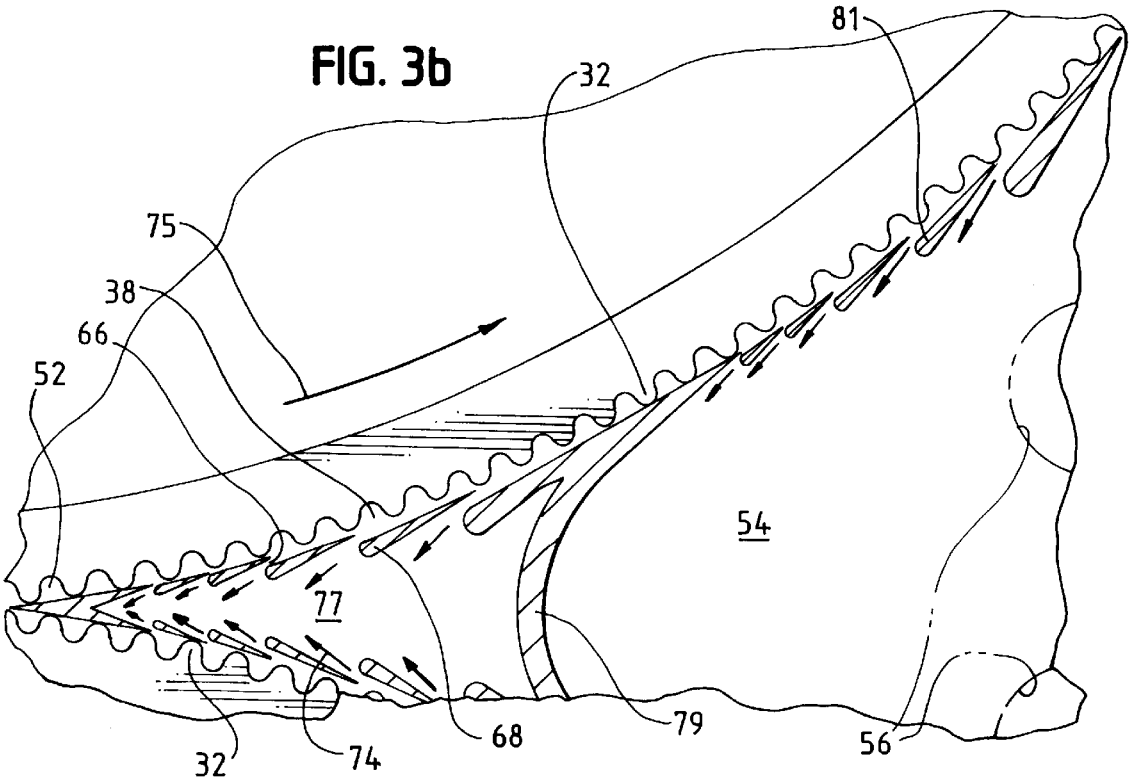
FIG. 3*b* is a fragmentary, enlarged sectional view of the expansion vane system, as shown in FIG. 3.
Figure 3C:
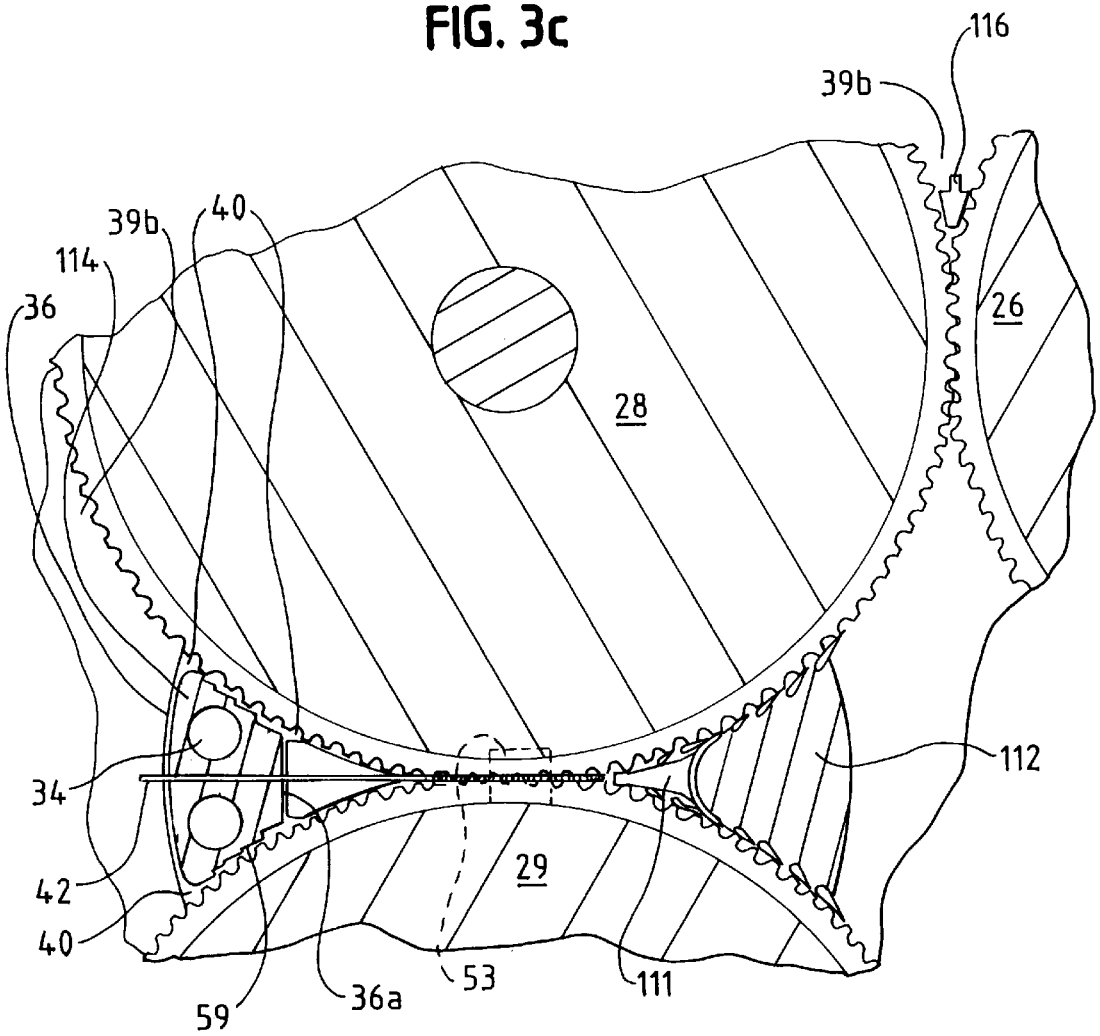
FIG. 3*c* is a fragmentary, sectional view of part of FIG. 3, taken along line 3*c*—3*c* of FIG. 4.

The exhaust coming from the opening chambers, and its handling, is illustrated in FIG. 3*b* and discussed below, as is the vane system used on the compression side of the rotors.

Referring again to FIG. 3*c*, it can be seen that groove seals 114 are also provided for each of the grooves 35, 37 on the "upstream" side of rotation of the rotors. Air inlet channels 34 can be seen to penetrate the groove seals, but the ends of the respective teeth 34 of the rotors are thus blocked at each groove seal 112 and 114. The air inlet channels 34 permit the passage of air along the length of the respective rotors.

Another set of groove seals 116 is provided in each of the respective grooves 35, 37 respectively between rotors 26, 28, and rotors 27, 29 to prevent the substantial loss of exhaust through those meshing rotors. This results in the maintenance of vacuum in the vacuum zone 39*b*. One should keep in mind that while chambers corresponding to chambers 25, 44, 52 are formed between teeth in the meshing areas adjacent seal 116, nothing can be transmitted through those chambers because of the absence of a "furnace" system of the type generally shown in FIG. 5, since the volumes of the chambers go to zero. Space may be provided at the ends of the rotors for recycling of exhaust into the exhaust zone from the compressed chambers. However, condensate from the exhaust may be absorbed or otherwise carried on the surface of the rotors and passed through into vacuum area 39*b*, where it may evaporate, resulting in a contribution to the cooling of the system.

FIGS. 7*a* through 7*d* show the preferred structure of the respective furnaces 51, 53. It is to be understood that these furnaces are typically of very small size, fitting into grooves 35, 37 of the respective gear rotors 28, 29.

Central furnace 51 comprises a ceramic chamber 78, which may be about 2–3 cm. in length, and being bracketed by a metallic frame 80, typically a high temperature alloy.

Ceramic furnace 51 defines a pair of intake ports 82, one on each side thereof, that each communicates to a flow passage 84 extending away from the dead center plane, DCP, and then extending through a series of ports 86 into central chamber 88, which extends through the dead center plane, DCP, as shown. This is possible because furnace 51 occupies groove 37.

Figure 7A:
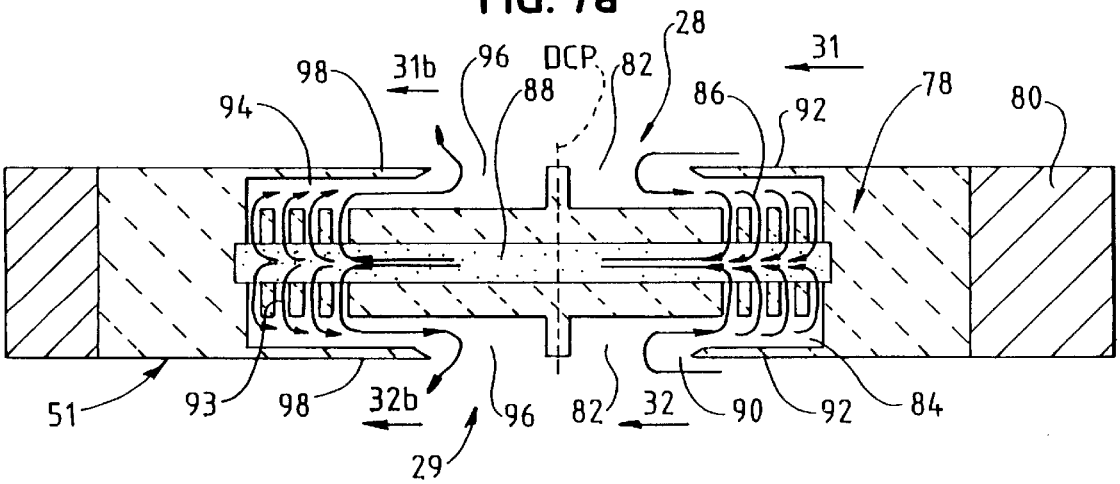
FIG. 7*a* is a fragmentary, highly enlarged, longitudinal, sectional view of the toothed rotors with a furnace chamber carried in the central circumferential groove of rollers of this invention, with parts removed.
Figure 8:
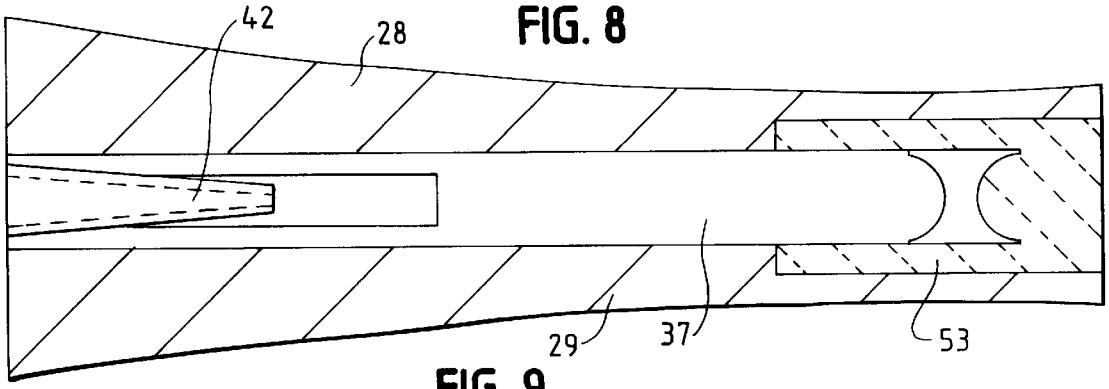
FIG. 8 is a simplified, greatly enlarged, longitudinal sectional view of mating roller sections and a furnace chamber, and also showing one of the lateral mixing cavities where fuel is mixed with air and water.

As shown in FIG. 7*a*, ceramic furnace 51 is in rotary contact with section 31 of the meshing gears on one side and section 32 of the meshing gears on the other, while occupying the groove 37 as previously disclosed. The rotating gear teeth of sections 31 and 32 are rotating toward the left from the perspective of FIG. 7*a*, with the respective chambers between the teeth diminishing in size to compress fuel and air therein. At point 90, the open ends of the chambers 46 (FIG. 6) are suddenly exposed to intake ports 82, at any desired compression ratio which is governed by the length of walls 92. The longer the walls 92 extend to the left, the smaller the chambers are between the gear teeth before they open into engagement with an intake port 82, and the higher the resulting compression is.

The high pressure fuel-air mixture passes through passageways 84, 86 into furnace chamber 88, with combustion taking place through dieseling action. In preferred embodiments of this design, hundreds or thousands of tiny chambers 46 per second are depositing their contents at high pressure into intake ports 82. Due to combustion in chamber 88, the pressure increases to ultrahigh pressure.

As the gear teeth continue their rotation across the dead center plane, DCP, the chamber volumes go to zero, and then begin to open again, forming chambers 52 (FIG. 6). Ultra high pressure fluid or plasma passes through ports 93 and passageways 94 to outlets 96, from which the ultra high pressure fluid presses against the sides of the respective gear teeth in sections 31*b*, 32*b* (FIGS. 4*a* and 7*a*) bursting into the respective chambers 52 as they open at the sides of the gear teeth. This is analogous to the power stroke of an internal combustion engine cylinder. The ultra high pressure burned fuel drives the powered opening of the chambers 52, causing the chamber volumes to expand, and receiving more ultra high pressure exhaust until the chamber is blocked by further rotation across walls 98, which seals the expanding chambers. Powered expansion of chambers 52 continues until the third stage compression sealing is lost, following which the exhaust is released from between the teeth as illustrated in FIG. 3*b*, with added power efficiency being provided by the vane system there.

It can be seen particularly from FIG. 5 that the wall of each ceramic chamber 78 is relatively thick, and each central chamber 88, 88*a* is of small diameter and volume, on the millimeter level, so that only a relatively small amount of fuel vapor (Typically no more than 1 cc) is undergoing combustion at any given time, but this combustion is taking place as a continuous process. Thus, the extreme conditions of combustion can be handled with great ease and optionally without the need for much cooling.

The flow path of burning fuel through furnace 51 can be seen to be circuitous, so as to lengthen the flow path to give the fuel time for burning. Extremely high velocities of the burning fuel passing therethrough are preferably used. The velocities may be supersonic.

Figure 7B:
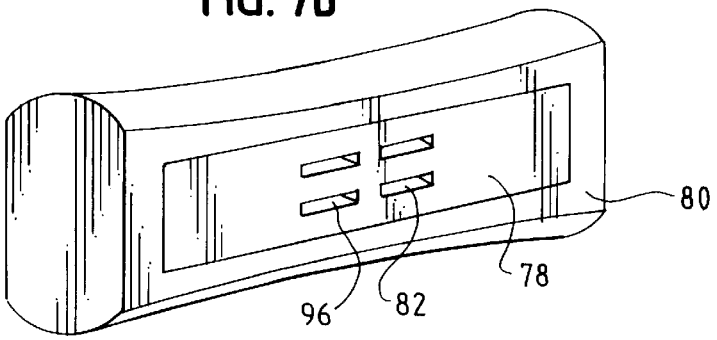
FIG. 7*b* comprises a greatly enlarged, perspective view of the central furnace chamber.
Figure 7C:
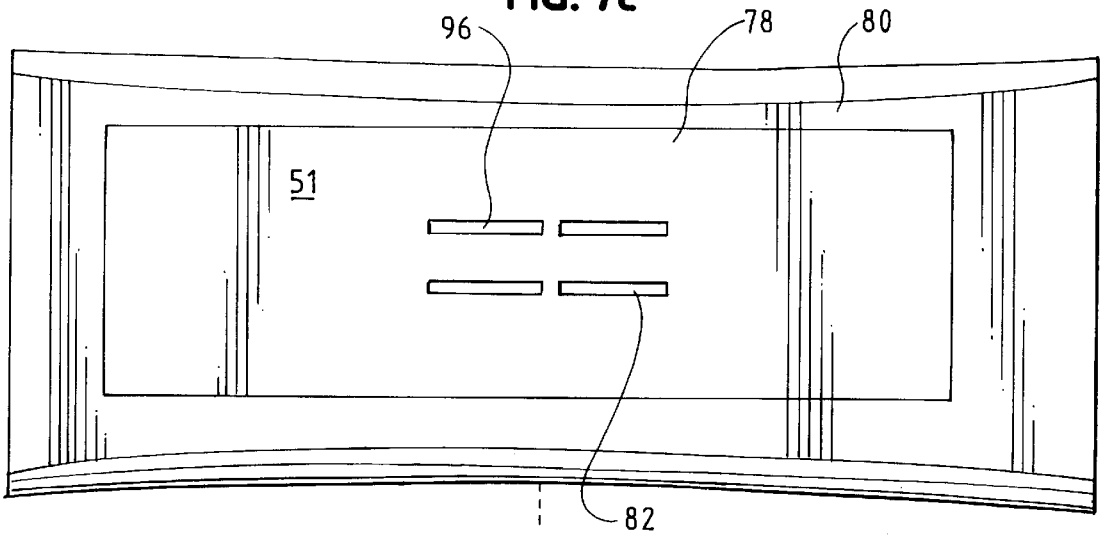
FIG. 7*c* comprises a greatly enlarged elevational view of the central furnace chamber.
Figure 7D:
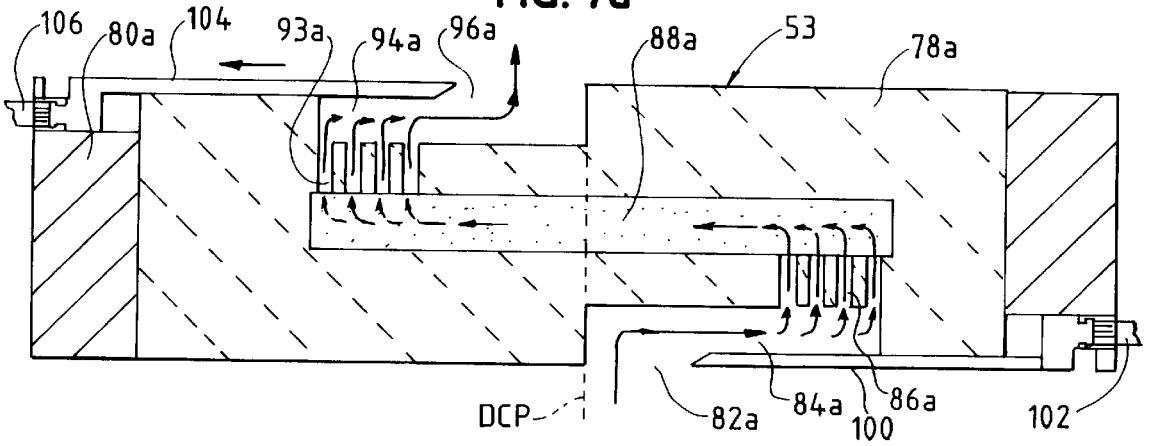
FIG. 7*d* is an enlarged, longitudinal sectional view of an outer furnace.

Referring to FIG. 7*d*, the design of outer furnaces 53 is shown.

Furnace 53 may be broadly similar in design to furnace 51, having a ceramic chamber 78*a* similar to furnace 51, a metallic frame 80*a*, and a single intake port 82 on only one side, connected as before to a passageway 84*a* and ports 86*a*.

Furnace chamber 88*a* is shown, being for the similar purpose of permitting combustion and consequent pressure increase of the fuel/air mixture to take place.

Then, as before, the ultra high pressure and temperature exhaust passes out of ports 93*a* and passageway 94*a* to outlet port 96*a*.

The chambers formed between the teeth of the respective rotary gear section 30, open at the edge of groove 35 and expelling their contents into entry port 82*a*. Ignition and combustion takes place, substantially in chamber 88*a* through the exposure to the ultra high pressure by dieseling action, while ultra high pressure and temperature exhaust passes into the opening chambers of rotor section 31*b*, so that ultra high pressure fuel is provided by this added route to the expanding chambers between the teeth.

The same process takes place from gear section 33, where the other outer furnace 53, in similar manner, shunts burning fuel across the dead center plane, DCP, from the closing chambers of section 33 to the opening chambers of section 32*b*.

Further in accordance with this invention, wall or "throttle" 100 is provided to each furnace 53 in a manner broadly similar to wall 92 of the embodiment of FIGS. 7*a–c*. As previously stated, wall 100 governs the rotational position in rotor section 30 at which the contracting chambers between the rotor teeth enter into communication with aperture 82*a* to discharge their contents. Thus, the length of extension of wall 100 governs the amount of compression of the fuel/air mixture before it is released to inlet 82*a*. In accordance with this invention, wall 100 is seen to be slidable in nature, being connected with a sliding rod 102 that can be controlled from outside of the motor. Thus, the compression ratio of the fuel entering each of the furnaces 53 can be controlled and varied, as the desired characteristics and the efficiency of the operation may require.

Similarly, a sliding wall 104 is provided near outlet 96*a*, to function in the manner similar to sliding wall 98, to cut off connection of outlet 96*a* to opening chambers at a desired rotational position. Here also, sliding wall or throttle 104 may be connected to a rod 106 which is controllable from the outside of the engine, so that the position of sliding wall 104 may be varied, for a resulting variation in engine functions.

Furnace 53 is otherwise similar in structure and function to furnace 51, except as otherwise indicated.

FIG. 8 is for the purpose of illustrating how fuel, optionally mixed with water, is fed through a fuel line 42, one fuel line 42 communicating with each of the rotor grooves 35, 37 as shown, with rotor groove 37 as being specifically shown.

Water or alcohol may also be mixed with the fuel, and thus is provided to the compressing chambers 44, 46 of the rotating gears. Reduced operating temperature and cleaner burning can be provided in this manner. Fuel line 42 may comprise coaxial water and fuel lines, so that the mixing with air takes place only in mixing chamber grooves 35, after the water and fuel have left the fuel line to enter the spaces between the teeth.

The specific rotating gear system disclosed herein may create a total about 960 "third stage" chambers per rotation of each of the gears. This is analogous to an internal combustion engine which has 3840 cylinders. This causes the exhaust to exhibit a tone of about 100 or more KHz, which is in the ultrasonic range and thus can be easily muffled by a condenser. At 18,000 rpm the specifically disclosed engine may produce 1,620,000 compressions per minute, each involving an extremely small amount of fuel and air, with a fuel residence time in combustion and expansion being about one tenth that of a diesel engine.

Further in accordance with this invention, a plurality of "upstream" vanes 58, 59 (FIG. 3*a*) are carried in the positions shown to partially shield the rotationally advancing teeth of the respective rotor gears 26–29 before they reach the meshing area 62. Vanes 58, 59 may be attached at their ends to end wall 60 of housing 12.

Thus, the air which is being driven out of the spaces between engaging teeth 32 at the tooth engagement area 62 flows rearwardly relative to the rotational direction as indicated by arrow 48. Because of the presence of vanes 58, this rapidly flowing air (rapid if the RPM of the rotor gears is rapid) is prevented for the most part from directly impinging the advancing faces of the respective teeth 32.

The pressure within chamber 39*a* of course tends to be increased by this retrograde air and fuel flow as indicated by arrow 48. Hence, a flow also takes place as indicated by arrow 64, indicating a flow into the spaces 66 between vanes 58, so that the gas flow tends to impinge the teeth in the direction of the rotation of the teeth 30, 32, rather than against the direction of rotation. This difference results in a continuous improvement in operating efficiency, since energy from the pressurized gases is added to the rotating teeth as implied by arrow 64, rather than being subtracted from the energy of the rotating teeth as would be indicated by arrow 48 in the absence of the vanes 58.

The same process takes place with respect to vanes 59, rotationally upstream of vanes 58. Referring to FIG. 3, one must remember that area 39*b* is a substantial vacuum, with outer wall 36 shielding the outer air chamber 39, to which air is supplied through inlet ports 34. Thus, air passes forcefully from chamber 39 to the open, evacuated spaces between teeth 32 as soon as the open spaces inwardly clear the seal provided by the ends of wall 36. The presence of vanes 59 direct this forceful filling of the spaces between the teeth 32, so that the flow of air is in the direction of rotation of the system. Then teeth 32 rotate into chamber 39*a*, and their spaces receive more pressurized air between vanes 58.

The sealing area 40 of each of the walls 36, 36*a* (FIG. 3*c*) should be long enough to cover and substantially seal at least about three teeth at a time.

The same process takes place rather in reverse on the "downstream" side of rotation, where chambers 52 are opening. As shown particularly in FIG. 3*b*, vanes 68 are provided in a manner and shape which is rather similar to the upstream vanes 58 discussed above. Arrows 74 show how the exhaust flies out of the spaces 38 between the teeth. The presence of vanes 68 provides a substantial shield to prevent the stream of gas indicated by arrows 74 from impinging against the gear teeth in a direction against the direction of rotation 75. Instead, vanes 68 are positioned so that the depressurizing, rapidly moving gas from chambers 52 is shielded from impinging the gear teeth while squirting like a jet against the direction of rotation so that by the "equal and opposite reaction", the energy of the expanding gasses is applied to the gear teeth in the direction of rotation of rotor gears 26–29.

FIG. 3*c* is a section taken along either of the grooves 35, 37 in the rotor, where groove seals 112, 114 are provided. One will recall from FIG. 4*a* that most of the pressurized fluid passes from the furnaces to sections 31*b*, 32*b* on the downstream side of the rotors. When this exhaust enters the first expansion chamber 77 through vanes 68 (FIG. 3*b*), it encounters communication channel 111, permitting pressurized hot gas to pass parallel to the axis of the rotors into corresponding portions of chamber 77 which are adjacent to sections 30*b* and 33*b* of the rotors. This results in expansion and pressure reduction of the hot gasses, which then pass through corresponding vanes 68 in these sections into the spaces between gear teeth of sections 30*b* and 33*b* (FIG. 4*a*), providing as they do so an added torque to the rotating gears. From there, the pressurized gasses pass across partition 79 (FIG. 3*b*) as shown to the final expansion vane system 81. The pressurized exhaust gas expands through the vanes 81 into exhaust zone 54, providing a final desirable torque to the rotors by jet action.

Hence, a further, continuous efficiency of operation is provided to the motor of this invention.

The respective rotor gears 26–29 also define secondary meshing areas 76 (FIG. 3), which do not pump exhaust, but merely recycle it to exhaust zone 54, lacking any chambers such as chambers 51, 53.

Figure 11:
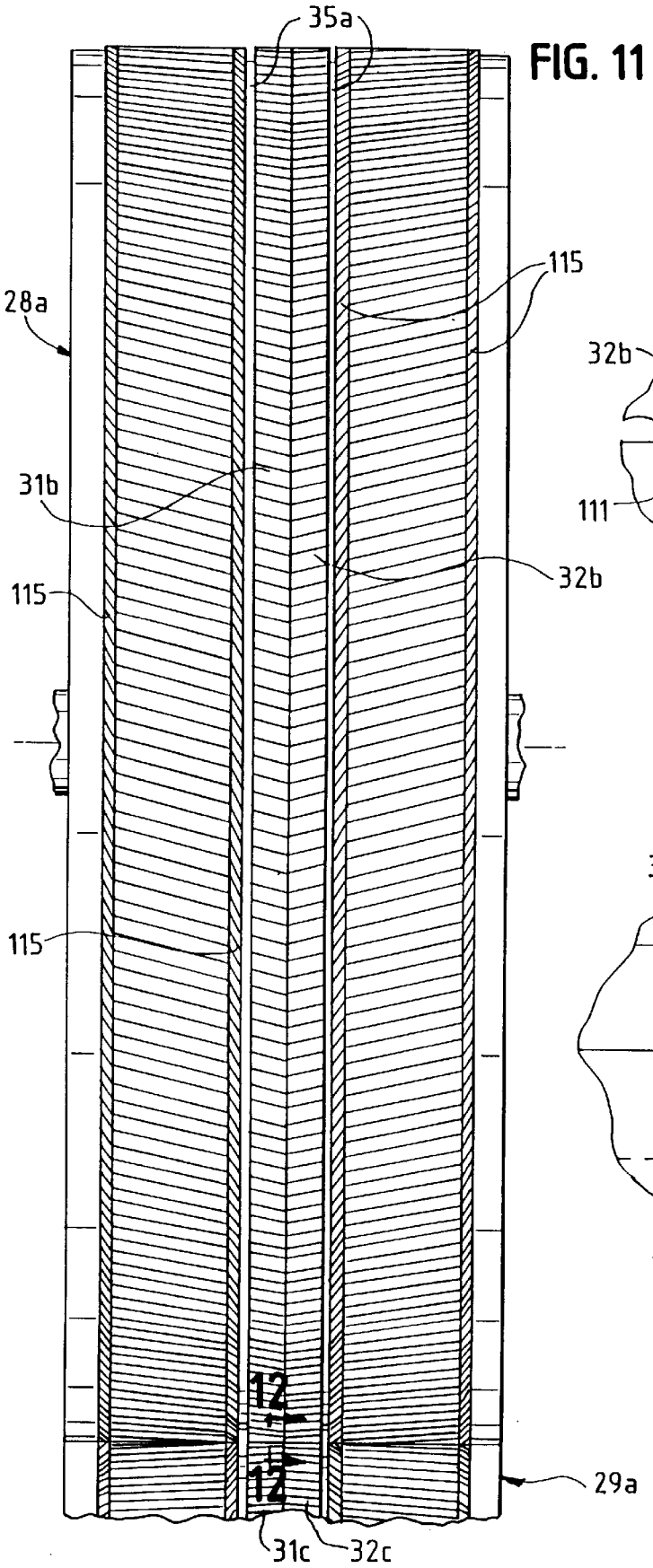
FIG. 11 is a partial, longitudinal sectional view of a portion of a modified embodiment of a motor similar to the view of FIG. 4 of the previous embodiment.
Figure 12:
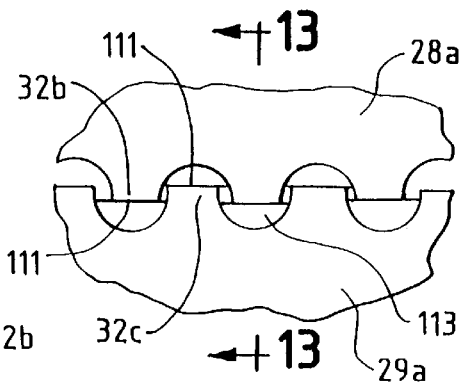
FIG. 12 is a highly enlarged sectional view of fragments having rotors with engaging teeth, taken along line 12—12 of FIG. 11.
Figure 13:
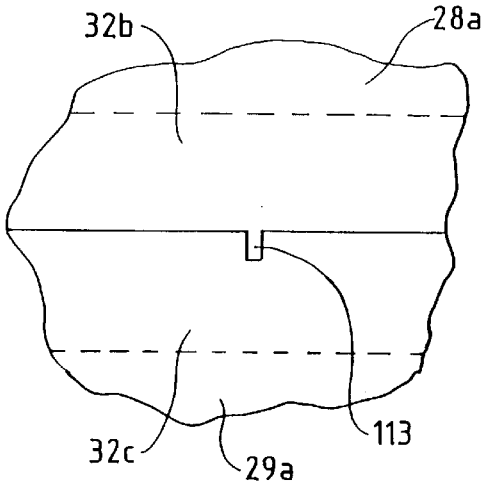
FIG. 13 is a fragmentary sectional view taken along line 13—13 of FIG. 12.

Referring to FIGS. 11 through 13, a modification of the motor described previously is shown, which modified motor is similar to the previous motor except as otherwise described herein.

FIG. 11 is a view similar to FIG. 4, showing gears 28*a*, 29*a* similar to their counterparts of the previous embodiment, except that central channel 37 and the corresponding furnace 51 are missing. Instead, central gear tooth sections 31*a*, 32*a* abut each other without being separated by an inner, annular groove.

The respective gear teeth 31*b* and 31*c*, and 32*b* and 32*c*, are of a different shape than their former gear tooth counterparts in the previous embodiment, having flattened outer faces 111 as shown in FIG. 12. Thus, the meshing gear teeth 32*b*, 32*c* define a series of spaces 113 between them at top dead center position that retain the compressed air-fuel mixture, thus eliminating the need for a central channel similar to channel 37 of the previous embodiment. Compressed fluid from recesses 113 can pass through spaces between the teeth to feed outer channels 35*a* in a manner similar to the previous embodiment.

Also, the ends 115 of teeth 31*b*, 31*c*, 32*b*, 32*c* define an obtuse angle to the main length of each of each of said teeth, as shown, which provides further operating efficiency.

The motor of this invention can also be used as a pump, simply by providing the energy of rotation to the rotor shafts 22, so that fluid is pumped from the inlets 34 to the outlet 56.

The above has been offered for illustrative purposes only, and is not intended to limit the scope of the invention of this application, which is as defined in the claims below.

That which is claimed is:

1. A rotary gear pump which comprises a housing, and at least a pair of rotatable, meshing gears positioned within said housing, said meshing gears defining spaced teeth which extend helically in the general direction of the axis of each gear rotation; a flow inlet and a flow outlet, each positioned in the housing to permit flow of fluid substantially longitudinally between said meshing gears as said gears rotate said teeth through a tooth-meshing area; and at least one first vane covering said teeth of each gear at a rotational position upstream of said tooth meshing area to shield the covered teeth from an energy-consuming backflow of fluid from said tooth-meshing area as said gears rotate.

2. The pump of claim 1 which comprises at least four rotatable, meshing gears positioned in interconnecting array in which each gear meshes with at least two other gears.

3. The pump of claim 1 in which a plurality of spaced first vanes are positioned to shield said gear teeth of each gear from said energy-consuming fluid backflow.

4. The pump of claim 1 in which a pair of spaced first vanes respectively covering teeth of different gears are connected to each other by a continuous wall to facilitate pressurization of fluid for pumping adjacent said first vanes.

5. The pump of claim 1 in which at least one second vane covers said teeth of each gear at a rotational position downstream of said tooth meshing area to cause expansion of fluid from between said gear teeth in a flow direction substantially opposite to the direction of gear rotation.

6. The pump of claim 5 in which each gear has a plurality of spaced second vanes positioned to direct said fluid in said substantially opposite flow direction.

7. The pump of claim 1 in which each gear carries from about 150 to 400 teeth.

8. The pump of claim 1 which is an internal combustion engine.

9. The rotary gear pump of claim 1 in which the spaced teeth of said meshing gears define first chambers which move substantially longitudinally while shrinking in size to substantially zero volume as they move toward a dead center plane, and second chambers are formed between said spaced teeth moving away from said dead center plane and increasing in volume, a substantially fixed volume combustion chamber positioned to receive fluid from said first chambers as they move toward said dead center plane and to provide pressurized fluid to said second chambers as they are formed adjacent said dead center plane and move away therefrom by rotation of said gears.

10. The pump of claim 1 which defines an outer housing, substantial volumes within said outer housing and surrounding said rotatable, meshing gears being evacuated.

11. A rotary gear pump which comprises a housing, and at least a pair of rotatable, meshing gears positioned within said housing, said meshing gears defining spaced teeth which extend helically in the general direction of the axis of each gear rotation; a flow inlet and flow outlet, each positioned in the housing to permit flow of fluid substantially longitudinally between said meshing gears as said gears rotate said teeth through a tooth-meshing area;

a plurality of spaced first vanes covering said teeth of said gears at a rotational position upstream of said tooth-meshing area to shield the covered teeth from an energy consuming backflow of fluid from said tooth-meshing area as said gears rotate, and at least one second vane covering said teeth of each gear at a rotational position downstream of said tooth-meshing position to direct depressurizing, expanding fluid from between said gear teeth into a flow direction substantially opposite to the direction of gear rotation.

12. The pump of claim 11 in which a plurality of spaced first vanes are positioned to shield said gears from said backflow, said vanes being positioned to deliver fluid flow to spaces between said teeth in the general direction of gear rotation.

13. The pump of claim 12 in which a pair of spaced first vanes respectively covering teeth of different gears are connected to each other by a continuous wall to facilitate pressurization of fluid for pumping adjacent said first vanes.

14. The pump of claim 13 in which a plurality of said second vanes respectively cover teeth of different gears, and are connected to each other by a continuous wall to facilitate pressurization maintenance of fluid adjacent said second vanes.

15. The pump of claim 14 in which each gear carries from 150 to 400 teeth, said pump being an internal combustion engine.

16. The pump of claim 14 in which at least one circular disc of smooth circumference is coaxially mounted with each rotating gear, each circular disk of each gear abutting and rotating against a circular disk of the other gear, to control minimum spacing.

17. The rotary gear pump of claim 14 in which the spaced teeth of said meshing gears define chambers which move substantially longitudinally while shrinking in size to substantially zero volume as they move toward a dead center plane, and second chambers are formed between said spaced teeth moving away from said dead center plane and increasing in volume, and a substantially fixed volume combustion chamber positioned to receive fluid from said first chambers as they move toward said dead center plane and to provide pressurized fluid to said second chambers as they are formed adjacent said dead center plane and move away therefrom by rotation of said gears.

18. The pump of claim 17 which comprises at least four rotatable, meshing gears positioned in interconnecting array in which each gear meshes with at least two other gears.

19. The pump of claim 18 which defines an outer housing, substantial volumes within said outer housing and surrounding said rotatable, meshing gears being evacuated.

* * * * *